US007765730B2

(12) United States Patent
Keng

(10) Patent No.: US 7,765,730 B2
(45) Date of Patent: Aug. 3, 2010

(54) ASSAULT RIFLE BACK-UP SIGHT RIB AND SUPPORT STRUCTURE

(76) Inventor: Da Keng, 875 Wharton Dr. SW., Atlanta, GA (US) 30336

( * ) Notice: Subject to any disclaimer, the term of this patent is extended or adjusted under 35 U.S.C. 154(b) by 139 days.

(21) Appl. No.: 11/635,770

(22) Filed: Dec. 8, 2006

(65) Prior Publication Data

US 2008/0092423 A1 Apr. 24, 2008

Related U.S. Application Data

(60) Provisional application No. 60/748,168, filed on Dec. 8, 2005.

(51) Int. Cl.
*F41G 1/00* (2006.01)

(52) U.S. Cl. ..... 42/111; 42/124; 42/128; 42/141; 42/148

(58) Field of Classification Search ..... 42/111, 42/124, 128, 138, 140, 141, 148
See application file for complete search history.

(56) References Cited

U.S. PATENT DOCUMENTS

| | | | | |
|---|---|---|---|---|
| 2,367,762 | A * | 1/1945 | Olsen | 42/148 |
| 3,732,642 | A * | 5/1973 | Bray | 42/124 |
| 4,691,442 | A * | 9/1987 | Center | 42/140 |
| 4,962,589 | A * | 10/1990 | LaRosa | 42/137 |
| 5,134,798 | A * | 8/1992 | Lee | 42/148 |
| 5,533,292 | A * | 7/1996 | Swan | 42/123 |
| 5,606,818 | A * | 3/1997 | Hardee | 42/124 |
| 5,941,006 | A * | 8/1999 | Horton | 42/124 |
| 6,508,027 | B1 * | 1/2003 | Kim | 42/124 |
| 6,606,813 | B1 * | 8/2003 | Squire et al. | 42/90 |
| 6,722,075 | B1 * | 4/2004 | Gabaldon | 42/141 |
| 6,732,467 | B1 * | 5/2004 | Luth | 42/138 |
| 6,779,288 | B1 * | 8/2004 | Kim | 42/72 |
| 6,779,290 | B1 * | 8/2004 | Houtsma | 42/148 |
| 6,854,206 | B2 * | 2/2005 | Oz | 42/124 |
| 6,895,708 | B2 * | 5/2005 | Kim et al. | 42/72 |
| RE39,465 | E * | 1/2007 | Swan | 42/71.01 |
| 7,216,451 | B1 * | 5/2007 | Troy | 42/72 |
| 7,296,376 | B2 * | 11/2007 | Kidd | 42/136 |
| 7,363,741 | B2 * | 4/2008 | DeSomma et al. | 42/85 |
| 7,367,152 | B2 * | 5/2008 | Samson | 42/128 |
| 2004/0000083 | A1 * | 1/2004 | Grant, Jr. | 42/112 |
| 2005/0000142 | A1 * | 1/2005 | Kim et al. | 42/124 |
| 2005/0011104 | A1 * | 1/2005 | Oz | 42/124 |
| 2005/0217161 | A1 * | 10/2005 | Haugen et al. | 42/124 |
| 2005/0241211 | A1 * | 11/2005 | Swan | 42/124 |
| 2005/0268519 | A1 * | 12/2005 | Pikielny | 42/124 |
| 2006/0075674 | A1 * | 4/2006 | Ding | 42/124 |
| 2008/0216380 | A1 * | 9/2008 | Teetzel | 42/127 |

* cited by examiner

*Primary Examiner*—Michael Carone
*Assistant Examiner*—Michael D David

(57) ABSTRACT

Back-up sights for use on a rifle configured with an optical sight aligned along a first sighting axis include a handguard or support carrying first and second attachment points that are substantially parallel with the central axis of the rifle's barrel but offset at a different angle than the first sighting axis. A back-up front sight and rear sight are carried on a back-up sight base, where the front sight and rear sight are aligned along a second sight axis that is offset, preferably, by one-eighth turn from the first sighting axis. When using the back-up sights, the user tilts or cants the rifle to one side, rotating the rifle one-eighth turn about the axis of the barrel's bore, to look down the second sighting axis, while aiming the rifle at the target.

20 Claims, 12 Drawing Sheets

ASSAULT RIFLE BACK-UP SIGHT RIB AND SUPPORT STRUCTURE

This application claims priority to provisional patent application No. 60/748,168, filed Dec. 8, 2005, the entire disclosure of which is incorporated herein by reference.

BACKGROUND OF THE INVENTION

1. Field of the Invention

The present invention relates to sights for use with assault rifles, other military rifles, tactical or hunting firearms or other shooting equipment typically used in exigent circumstances with optical alignment instruments.

2. Discussion of the Prior Art

Military arms including assault rifles such as the M16A2 and the M4 are used by soldiers and marines under the most difficult conditions, and those rifles often take quite a beating.

The modern soldier or marine can be equipped with a wide variety of equipment and so the rifles have at times been adapted to carry things not formerly found on combat infantry weapons. In response, accessory supporting handguards have been offered that carry from one to four longitudinally aligned picatinny rail style mounting supports. Such supports are offered by quite a number of companies such as Knights Armament and ARMS. The Knights Armament rail support has wide usage in the military and is known as the RIS (Rail Interface System), and the RIS support replaces the front hand guard on an M16A2 or the M4.

The typical Colt-supplied front hand guard on the M4 is just a plastic sleeve structure in two halves and has a double walled heat shield. The standard front hand guard doesn't have any support or attachment point for accessories, since it doesn't have the picatiny rails. So the standard front hand guard has to be removed to allow use of, e.g., the RIS. One often sees troops in combat with standard M4 hand guards or forends but more and more the troops are changing to RIS forends because they are hanging a variety of accessories on the RIS handguard replacement supports, such as laser pointers, flash lights, bipods. As a result, one problem is that many M4s carried in the field nowadays are optic-sight only. The rifles carrying the RIS accessory rails are often equipped with either ACOG® AimPoint® or EOTech® optical sights, and optical sights such as these may be damaged when exposed to rough use.

If a soldier were to drop his or her weapon and that optical sight was rendered ineffective, it would be good for them to have something to fall back on until they can get back to an armorer. The back-up sights typically in use are standard issue or flip-up sights. Back up iron sights are available on the M4, since the front sight is still affixed to the barrel and so a flip-up rear sight is also provided, but in order to bring it the standard back-up iron sights to use, one must remove the damaged optical sight and then flip the standard rear sight up. So there are two motions; the first, removing the optical sight, is easier on some models than others. But optical sight removal turns out to be quite a chore in some cases, and the soldier or marine may be engaged in a firefight and unable to stop for a session of impromptu gunsmithing.

There is a need, therefore, for a structure and method permitting the shooter to continue engaging his or her target after an assault rifle carrying an optical sight has been impacted in a manner that renders the optical sight inoperative.

SUMMARY OF THE INVENTION

An object of the present invention is to provide a structure and method permitting the user or shooter to continue engaging her or his target after an assault rifle or other weapon carrying an optical sight has been impacted or damaged in a manner that renders an attached optical sight inoperative.

Another object of the present invention is providing a rugged, low-profile backup sight system that can be brought to bear almost immediately in a natural motion that is easily understood by any user or shooter.

The aforesaid objects are achieved individually and in combination, and it is not intended that the present invention be construed as requiring two or more of the objects to be combined.

In accordance with the present invention, a back-up sight system is configured in a replacement handguard carrying, preferably, three of four picatinny rail-style mounts, and the back-up sights are tucked into the sidewall between the top rail and a selected side rail, so that a shooter or user can just tilt the rifle one eighth turn to one side or the other and look down the back-up sights whenever the primary or optical sights are rendered unusable. The principal or optical sights are aligned along what is called the first sighting axis, usually just above the rifle barrel's bore.

When using the back-up sights of the present invention, the user tilts or cants the rifle to one side, rotating the rifle approximately one eighth turn about the axis of the barrel's bore, to look down the second sighting axis while aiming the rifle at the target.

The back-up sights are preferably affixed to the rifle's handguard or support at first and second attachment points, where the support's first and second attachment points are aligned to be substantially parallel with the central axis of the rifle or carbine's barrel but rotated or radially spaced from the first sighting axis. A front sight and rear sight are carried on a back-up sight base, where the front sight and rear sight are aligned along the second sight axis parallel to the barrel or bore but rotated or radially spaced from the first sighting axis.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE PREFERRED EMBODIMENT

Figure 1:
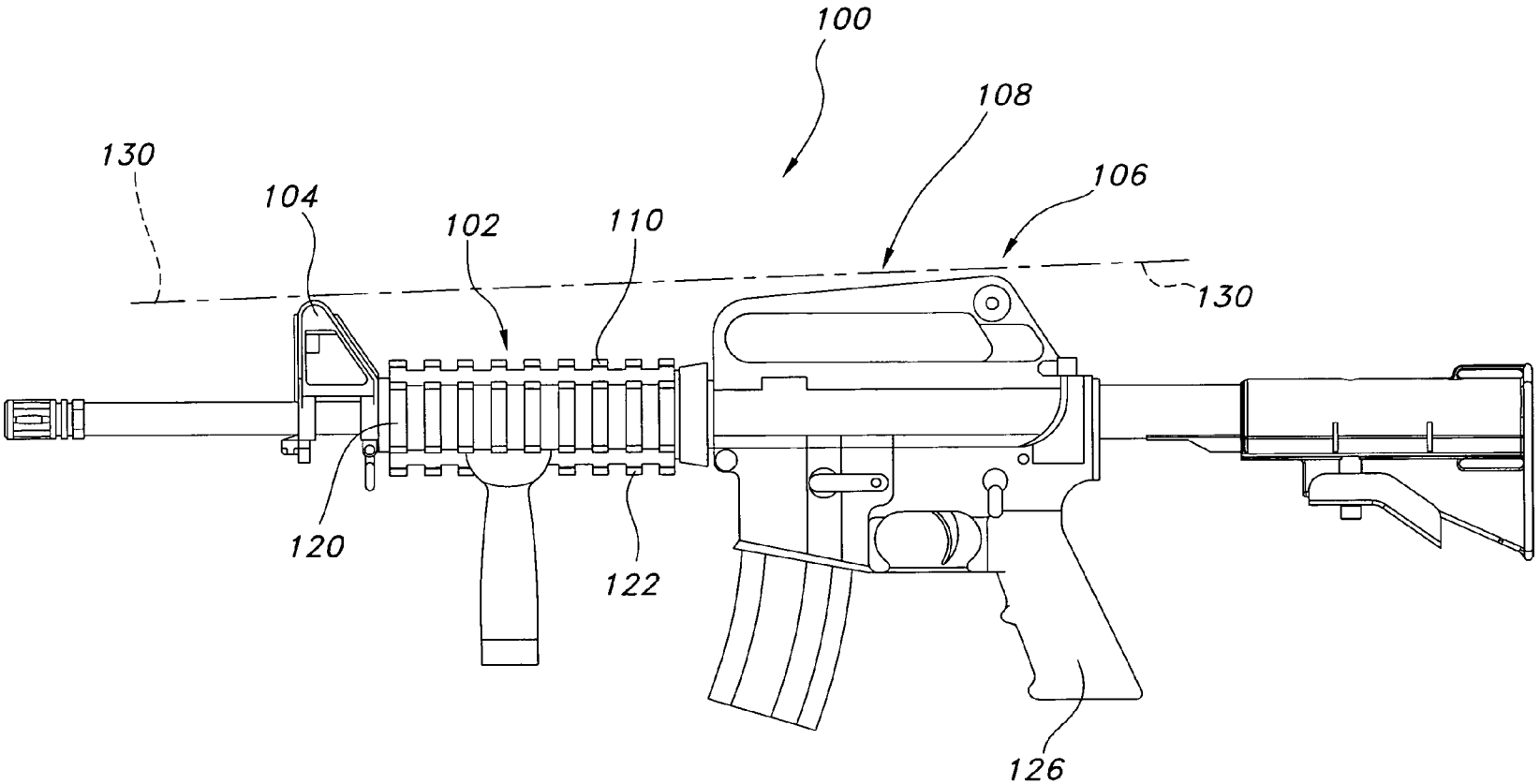
FIG. 1 (PRIOR ART)
FIG. 1 illustrates the left side in elevation of a prior art AR family rifle (specifically, the M4 carbine) showing the standard front hand-guard and standard sights.
Figure 2:
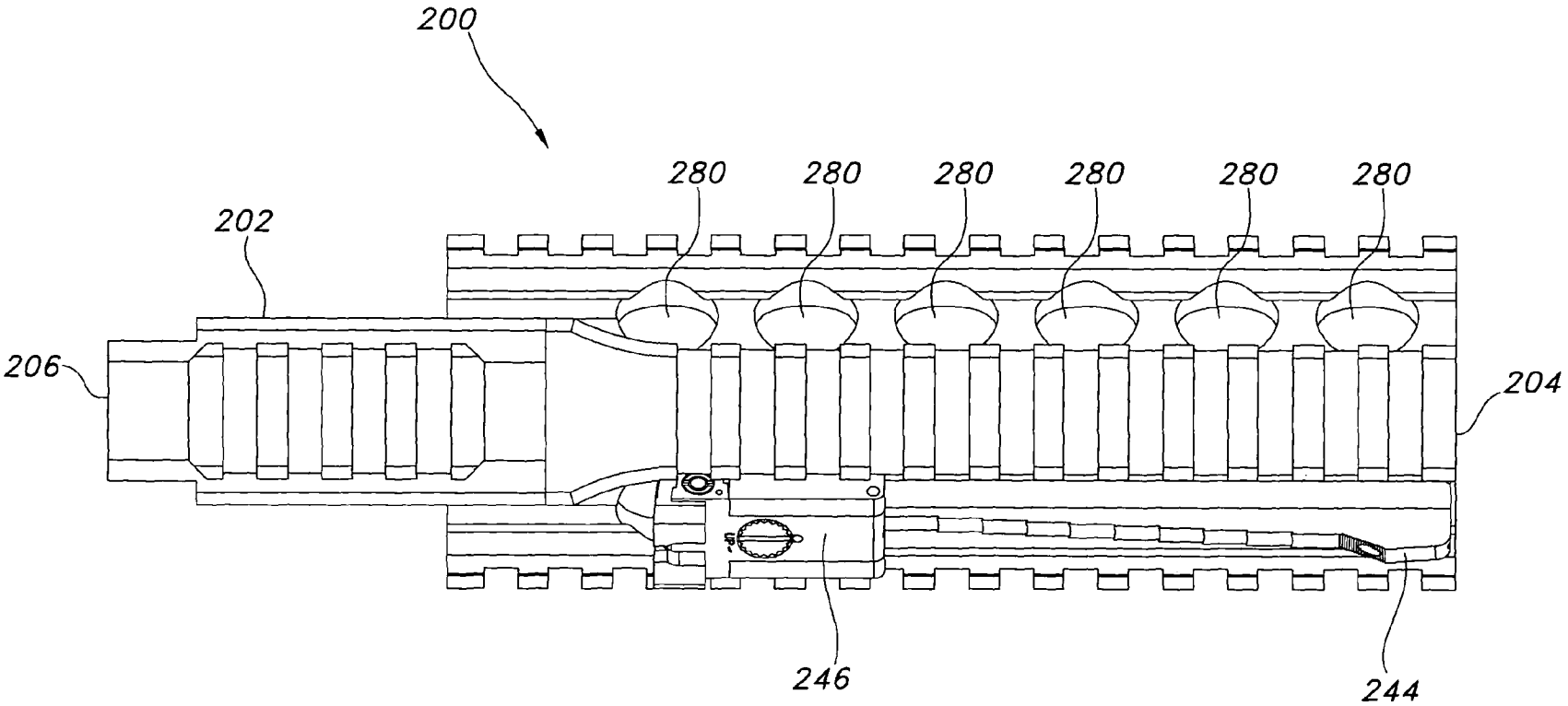
FIG. 2 illustrates a top view in elevation of a back-up sight and replacement handguard or support, in accordance with the present invention.

Referring to FIGS. 1-12, a typical rifle (e.g., an M4) 100 having a Rail Interface System (RIS) fore-end or handguard 102 allows the user to attach a variety of accessories on the RIS rail supports, such as laser pointers, flash lights, bipods. The rifles carrying the RIS accessory rails are often equipped with either ACOG® AimPoint® or EOTech® optical sights (not shown) that may be damaged when exposed to rough use. If a soldier were to drop his or her weapon and that optical sight was rendered ineffective, then the back-up sights typically in use are standard issue front and rear sights 104, 106 that are aligned with the mounting location 108 for the optical sight. Back up iron sights are available on the M4, since the front sight 104 is still affixed to the barrel and rear sight 106 is also provided, but in order to bring the standard back-up iron sights to use, one must remove the damaged optical sight from mounting location 108 and removing the optical sight is easier on some models than others. As noted above, optical sight removal turns out to be quite a chore in some cases, and the soldier or marine may be engaged in a firefight and so won't stop for a session of impromptu gunsmithing while ignoring a target.

The back-up sights of the present invention, as shown in FIGS. 2-12, permit the shooter to continue engaging his or her target after an assault rifle (e.g., 100) carrying an optical sight has been impacted in a manner that renders the optical sight inoperative.

In accordance with the present invention, a back-up sight system is configured for use with a replacement handguard carrying, preferably, three of four picatinny rail-style mounts (similar to the Knight or SOPMOD RIS), and the back-up sights are tucked into the space or sidewall between the rails, so that a shooter or user can just tilt the rifle to one side or the other and look down the back-up sights whenever the primary or optical sights are rendered unusable. The primary sights (e.g., standard iron sights 104, 106) or optical sights (not shown) are aligned along what is called the first sighting axis 130, usually just above the rifle barrel's bore.

When using the back-up sights, the user tilts or cants the rifle to one side, rotating the rifle by a selected angle, $\Theta$, (e.g., less than one quarter turn and preferably approximately one eighth turn or 45 degrees) about the axis of the barrel's bore, to look down the second sight axis 230 (see, e.g., the illustrated axes in FIG. 4*b*) defined by the back-up sights, while aiming the rifle at the target.

The back-up sights are affixed to the rifle's handguard or support 202 (e.g., similar to RIS or handguard 102) at first and second attachment points, where the support's first and second attachment points are aligned along an axis that is substantially parallel with the central axis of the rifle's barrel but rotated to a different angle from the first sighting axis 130, as viewed when looking down the bore's axis. A back-up front sight and rear sight are carried on a back-up sight base such as sight base 242, best seen in FIG. 6 or sight base 302, best seen in FIG. 10, where the front sight and rear sight are aligned along the second sight axis 230. In the exemplary embodiment of FIGS. 6, 7*b* and 9, sight base 242 carries front sight blade 244 and rear sight 246 in a configuration adapted for alignment along secondary axis 230.

The back-up sight mount of the present invention mounts the sight in an area that is unobtrusive because the various attachments can all be mounted around it. It doesn't take up any of the valuable real estate on the RIS' picatiny rails. When an optical or primary sight riding on top of the rifle becomes inoperable, all the shooter has to do is turn his or her wrist ⅛ of a turn to the left (or if mounted on the other side, to the right). This provides a very natural motion, just turn the wrist and start shooting again.

The back-up sights are similar to pistol sights adapted for use in Practical Pistol Competition (e.g., a PPC rib for a revolver), and so the sight picture is adapted for use not with a traditional rifle shooter's cheek weld but instead when holding the weapon out in front of one's face. Additionally, luminescent (e.g., tritium) sight inserts are optionally included.

The advantages of the sights and method of the present invention will be apparent to those having skill in the art, but first of all it is quick to use, there is nothing to flip, and it optionally adds tritium for use in low light. There are also a couple of other advantages, when one uses an optical sight such as an ACOG® or AimPoint® mounted on the M4, the optical sight necessarily sits up quite high off the weapon, and so when shooting through a small hole in the wall, the shooter might be able to poke the barrel and the fore-end through but may not then be able to see through the optical sight because the hole is not big enough; with the back-up sight of the present invention, the second sight axis 230 is nearly within the outer circumference created by the RIS' rails, and so as long as one can stick the fore-end 202 through the hole, one can shoot through it.

The back-up sight of the present invention also gives an advantage shooting from the prone position under low obstacles; one can shoot under a vehicle (e.g., a Hum-V) because not only can the shooter sight this way, the magazine (e.g., a 30 round magazine) instead of standing straight up, is turned on the side, and so since the second sight axis is off at an angle, the shooter has the magazine sticking downwardly at an angle, instead of straight down. So the shooter may shoot holding the rifle canted to the side with a much lower profile from underneath the vehicle, making him or her practically un-hittable with return fire.

Figure 3:
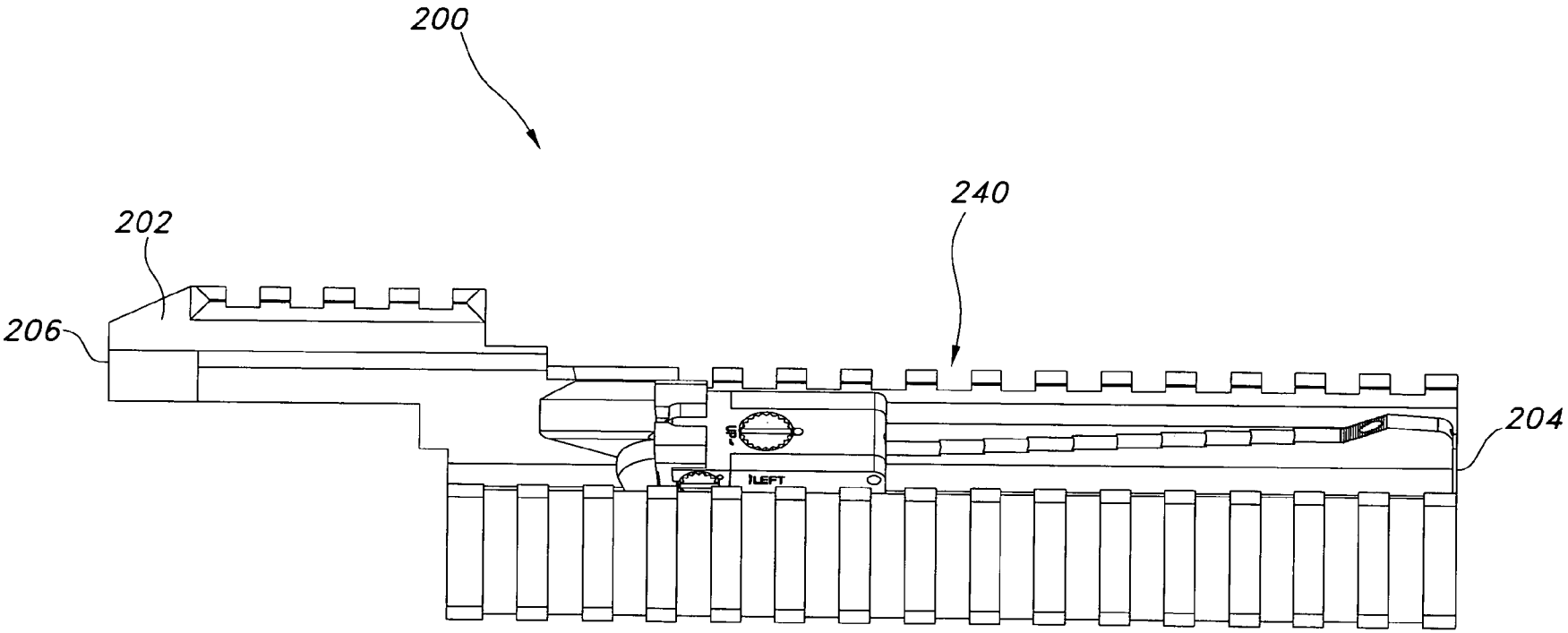
FIG. 3 illustrates a side view of the back-up sight and support of FIG. 2, in accordance with the present invention.
Figure 4B:
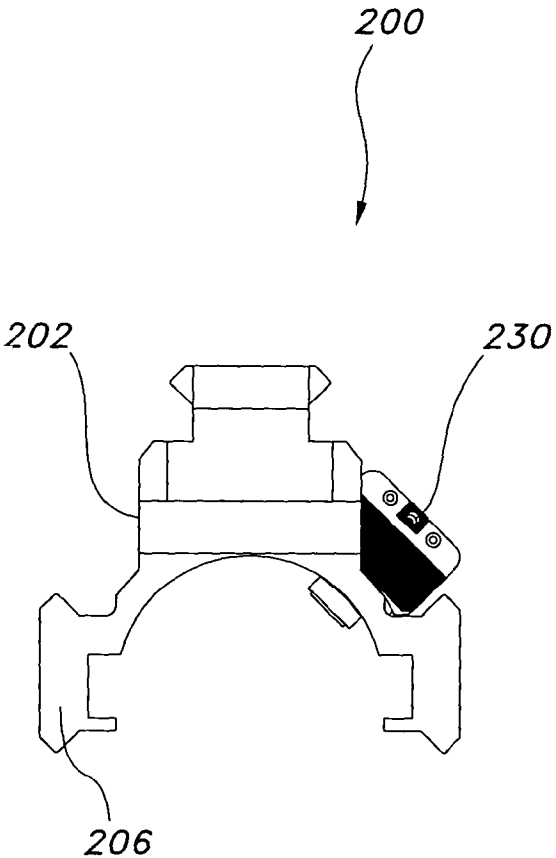
FIGS. 4*a* and 4*b* illustrate front (i.e., distal or muzzle) and rear (i.e., proximal or user) views, respectively, of the back-up sight and support of FIG. 2, in accordance with the present invention.
Figure 4A:
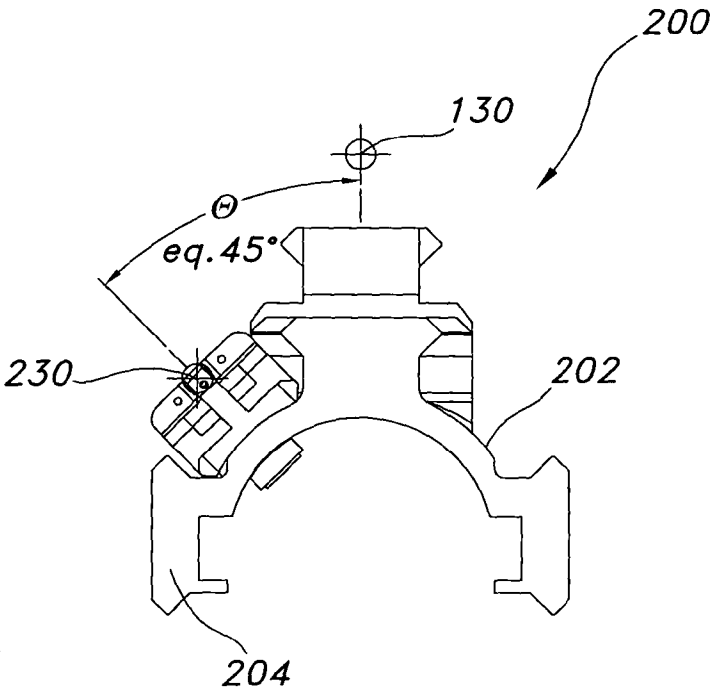
Figure 5:
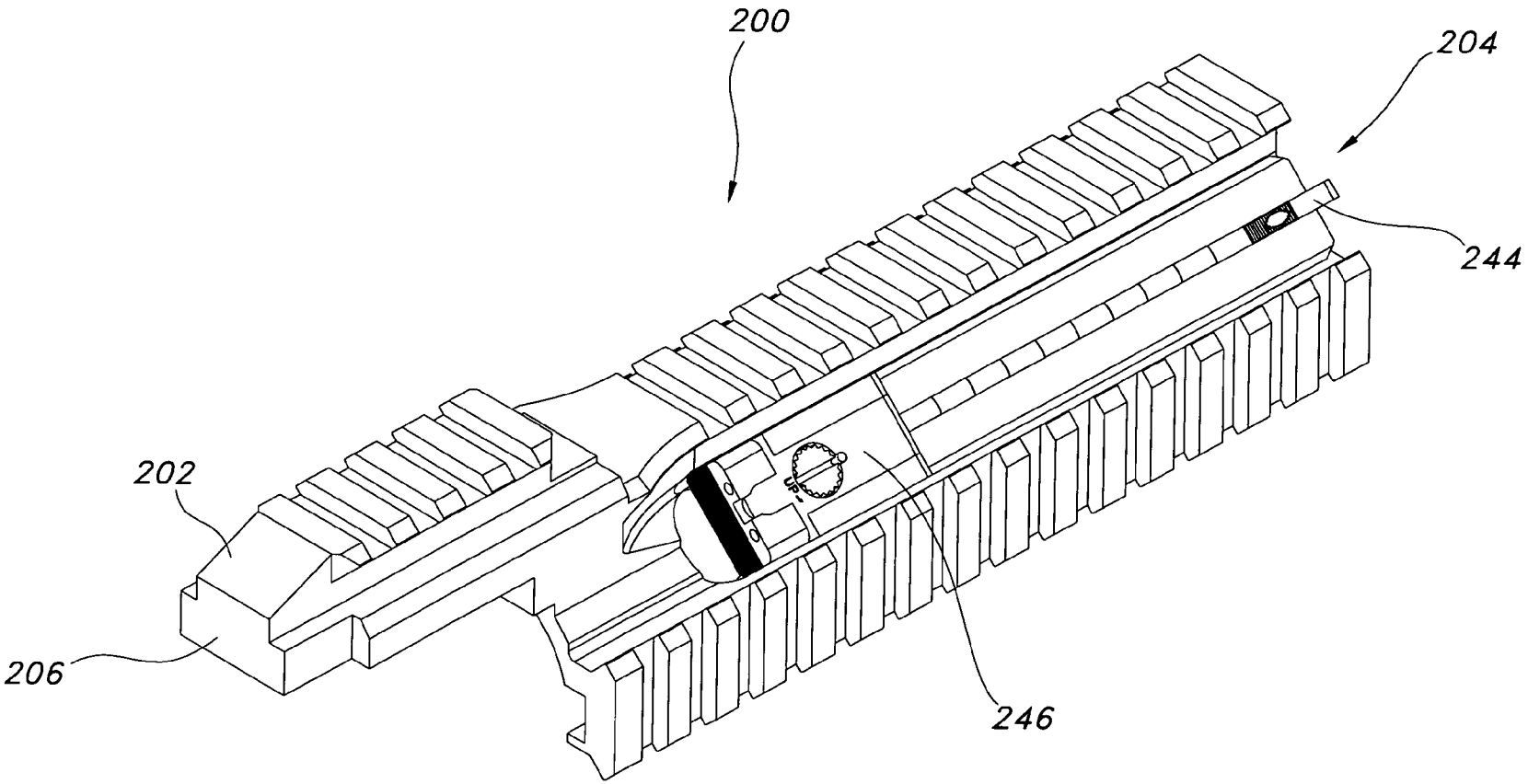
FIG. 5 illustrates a rear perspective view of the back-up sight and support of FIG. 2, in accordance with the present invention.
Figure 6:
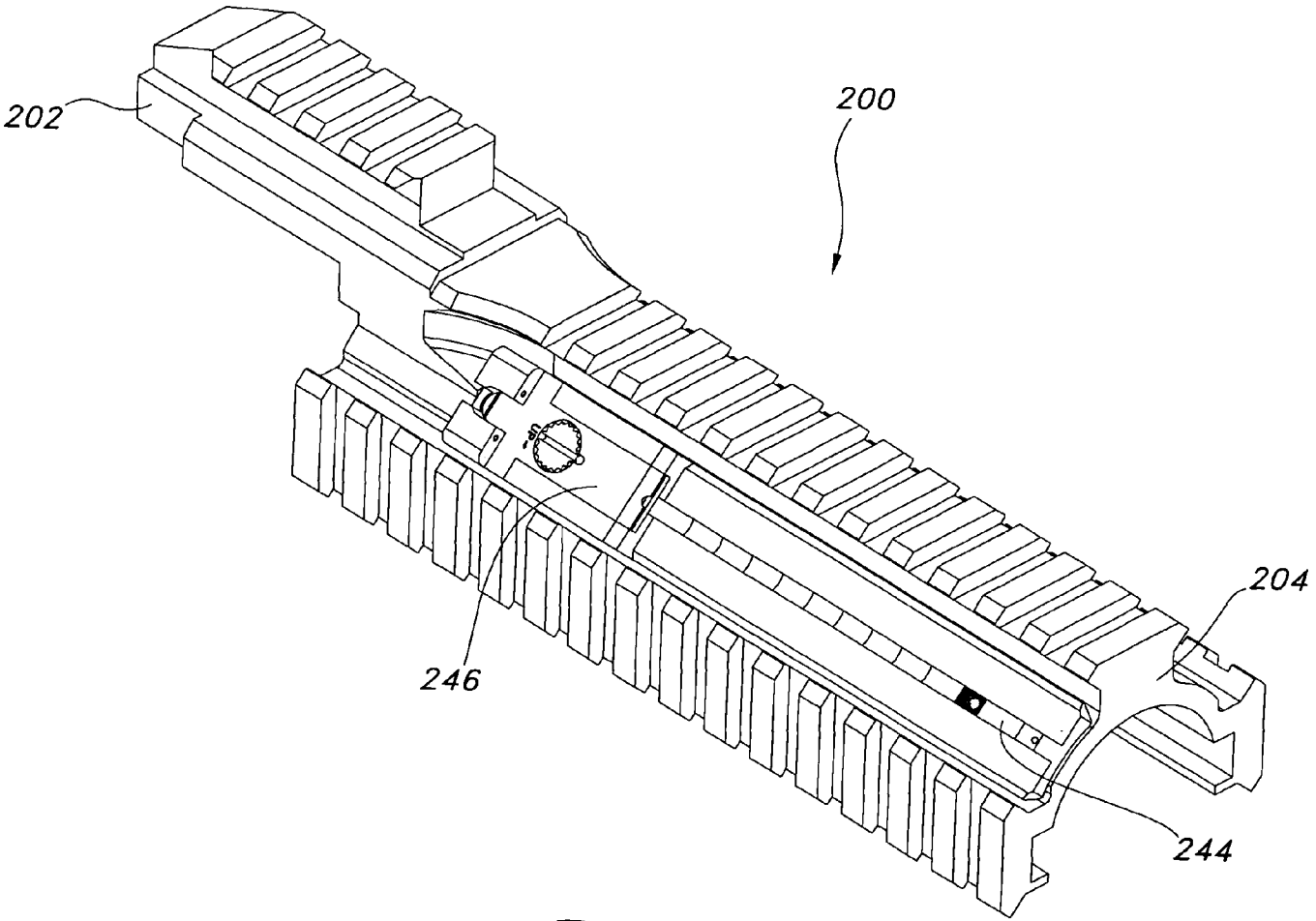
FIG. 6 illustrates a front perspective view of the back-up sight and support of FIGS. 2-5, in accordance with the present invention.
Figure 7B:
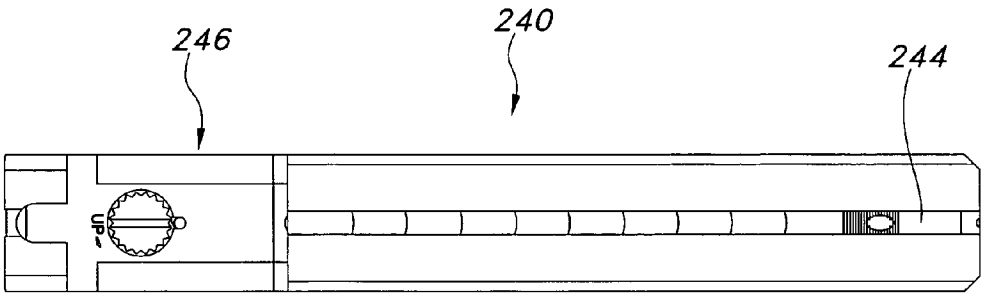
FIGS. 7*a*-7*d* illustrate, in four views, the sight base sub-assembly included in the back-up sight and support of FIGS. 2-6, in accordance with the present invention.
Figure 7C:
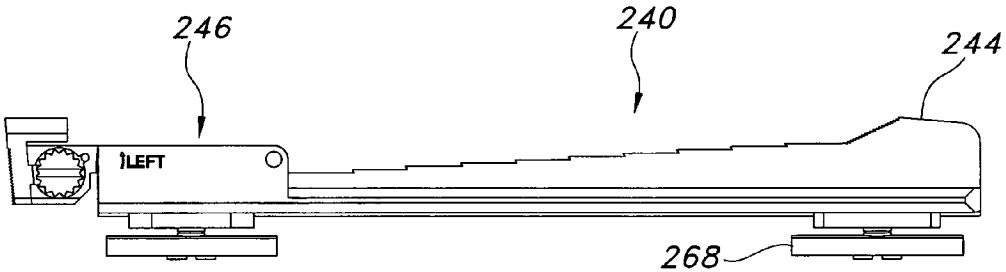
Figure 7D:
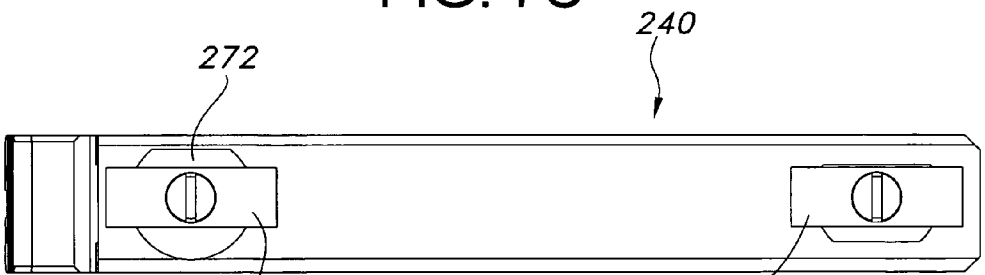
Figure 7A:
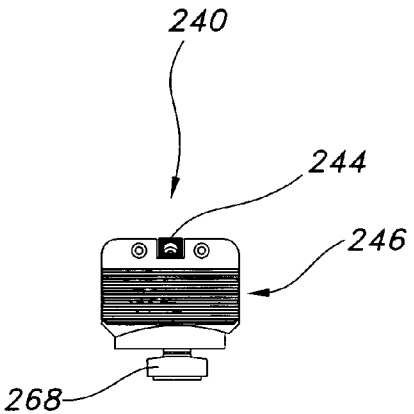
Figure 8C:
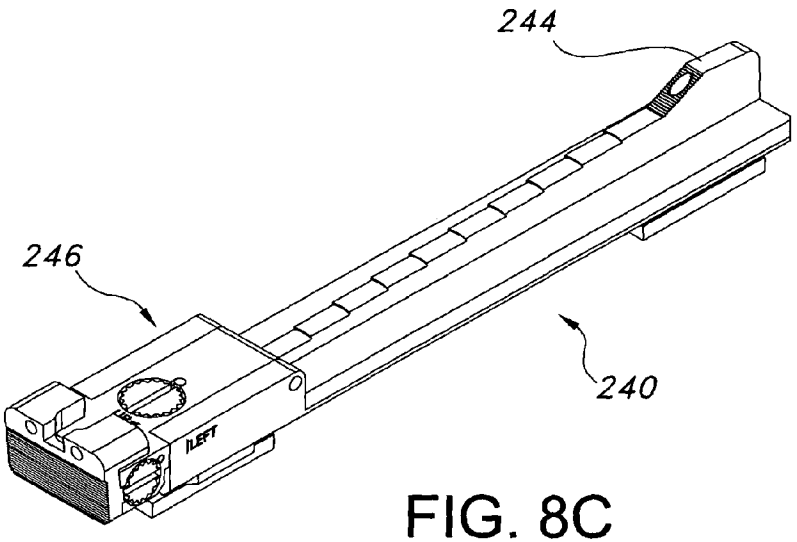
FIGS. 8*a*-8*d* illustrate four more views of the sight base sub assembly of FIGS. 7*a*-7*d*, in accordance with the present invention.
Figure 8A:
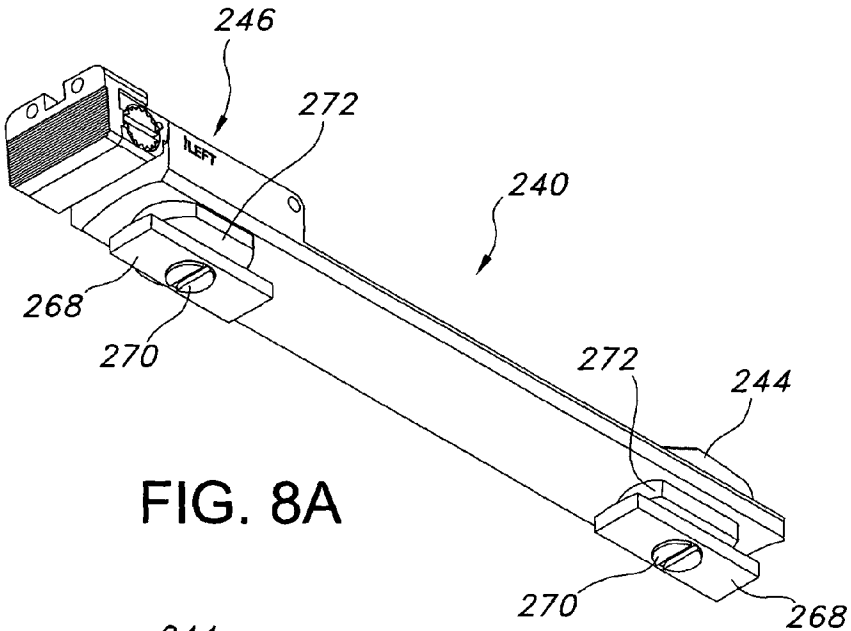
Figure 8D:
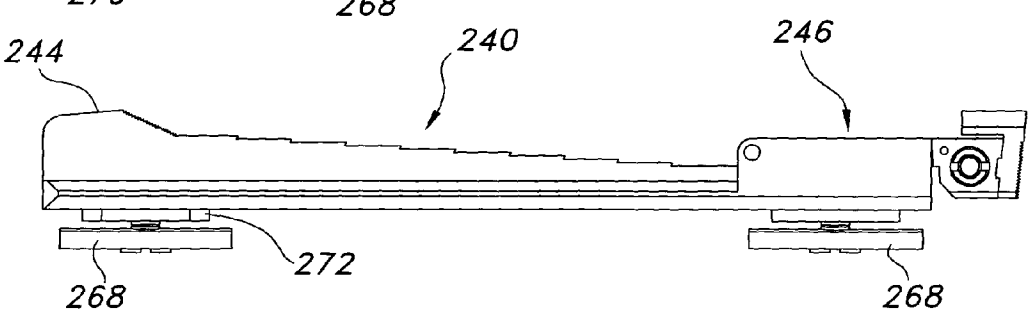
Figure 8B:
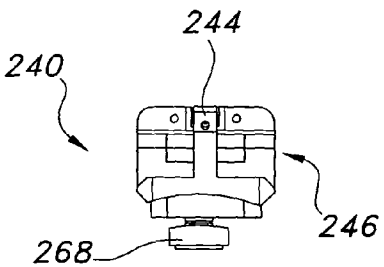

Referring specifically to FIGS. 2-6, a first embodiment of the back-up sight assembly 200 includes a SOPMOD or RIM style replacement handguard or support member 202 adapted for use on an AR Family rifle (meaning, for example, an AR-15, M4 or one of variants of the M16, among others). FIG. 3 illustrates a side view of the back-up sight assembly 200, and FIGS. 4*a* and 4*b* illustrate the front (i.e., distal or muzzle facing) surface 204 and rear (i.e., proximal or user facing) surface 206, respectively, of back-up sight 200 assembly. FIG. 5 illustrates a rear perspective view of the back-up sight assembly 200 and FIG. 6 illustrates a front perspective view, in accordance with the present invention.

Figure 9:
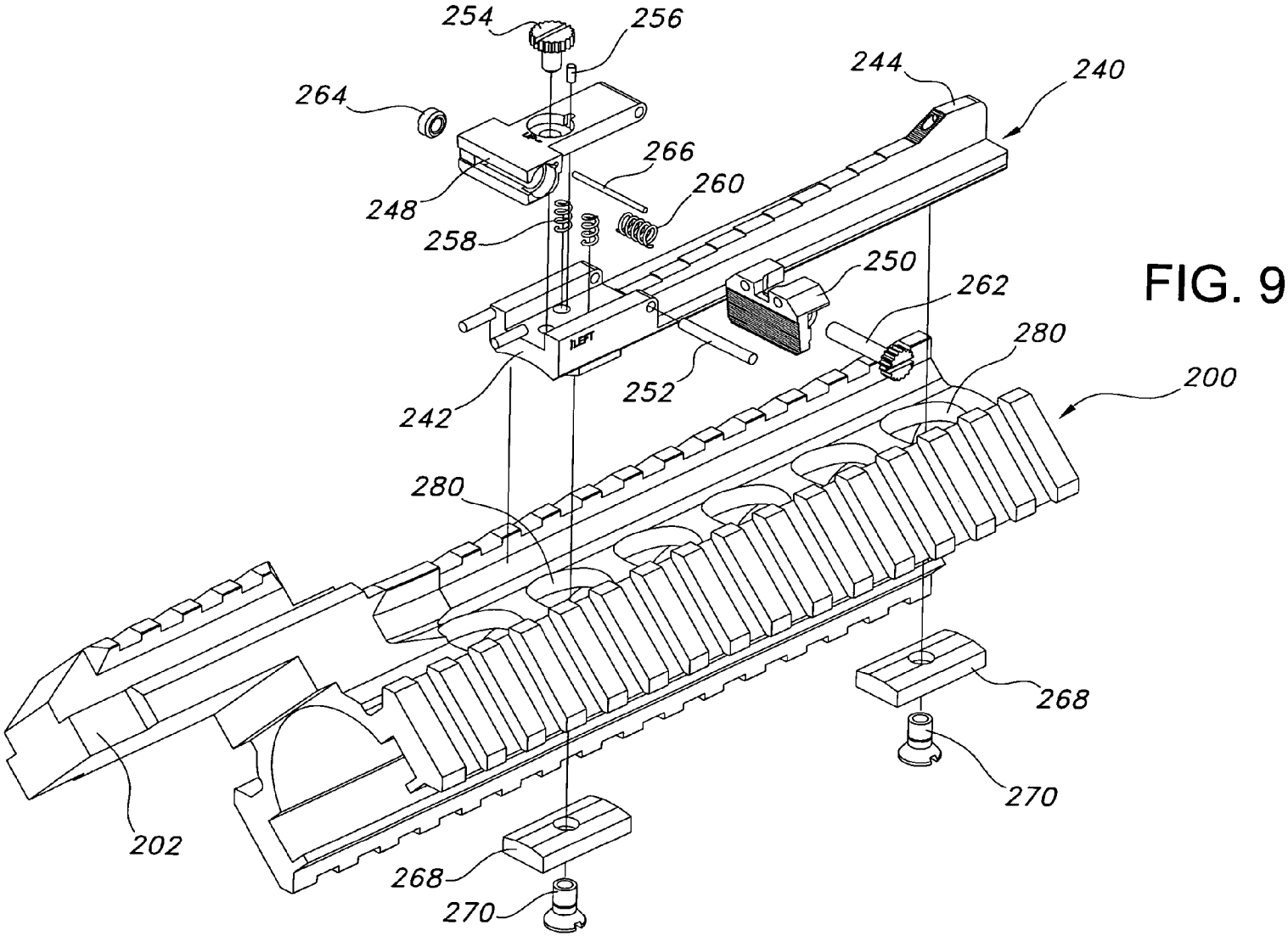
FIG. 9 illustrates, in an exploded perspective view, the back-up sight and support of FIGS. 2-6, in accordance with the present invention.

FIGS. 7*a*-7*d* illustrate four views of the sight base sub-assembly 240 included in the back-up sight 200 and FIGS. 8*a*-8*d* illustrate four more views of sight base sub-assembly 240, which, as shown in the exploded view of FIG. 9, include sight base 242 with integral tritium equipped front sight 244 and a windage and elevation adjustable rear sight assembly 246.

In the exemplary embodiment illustrated in FIGS. 1-9, rear sight assembly 246 includes a proximal portion of sight base 242 defining a hinged support region having a central open trough between sidewalls dimensioned to receive a pivoting sight top member 248 that carries a rear sight blade 250 defining the rear sighting notch, preferably also with tritium inserts (as best seen in FIG. 9). Pivoting top member 248 is retained by hinge pin 252 and responds to elevation adjustments via the scalloped head of elevation screw 254 which is stabilized by elevation detent pin 256 and elevation bias springs 258. Top member 248 has a proximal. transverse bore that is configured to slidably receive the rear sight blade's cantilevered support with a cylindrical threaded member cooperating with threaded windage screw 262 and windage bias spring 260, all of which are retained by windage nut 264. Windage detent pin 266 is received in a second transverse bore and is biased against the scalloped head of windage adjustment screw 262.

Sight base subassembly 240 is removably affixed to handguard or support 202 via attachment points, apertures or cooling holes 280. Sight base 242 has first and second radiused bosses or projections 272 positioned and dimensioned to fit snugly within and engage the inner peripheral surfaces of spaced, aligned apertures 280. The base's projections 272 have threaded blind bores sized to receive threaded screws 270.

When installed, the back-up sight assembly 240 is placed against handguard 202 with projections 272 inserted into handguard apertures 280. Preferably, first and second retaining plates 268 are then placed against the interior surface of the handguard or support 202 and one or more retaining screws 270 are used to releasably fasten sight assembly 240 tightly into handguard 202 to provide a rugged and reliable sighting system.

FIGS. 9-12 illustrate different embodiments having different sight bases. The narrow base 300 is the lightest weight approach, for a bare bones amount of weight achieving the same utility. Flat, wide base 302 is similar to a PPC revolver type rib basically with a concave bottom surface, and base 302 adds more weight but also gives a more robust appearance.

For base 300, the top surface 304 is preferably sand blasted. Another embodiment, base 308, cuts down the glare with an array of arcuate grooves defining a substantially non-reflective surface but base 308 is more expensive to make. Base 242 resembles an historic design by an old gunsmith, Travis Strayhan, and has a raised rib on top of a PPC rib incrementally rising in steps to the top of the front sight 244, to help the shooter to pick up the front sight more quickly.

Figure 10:
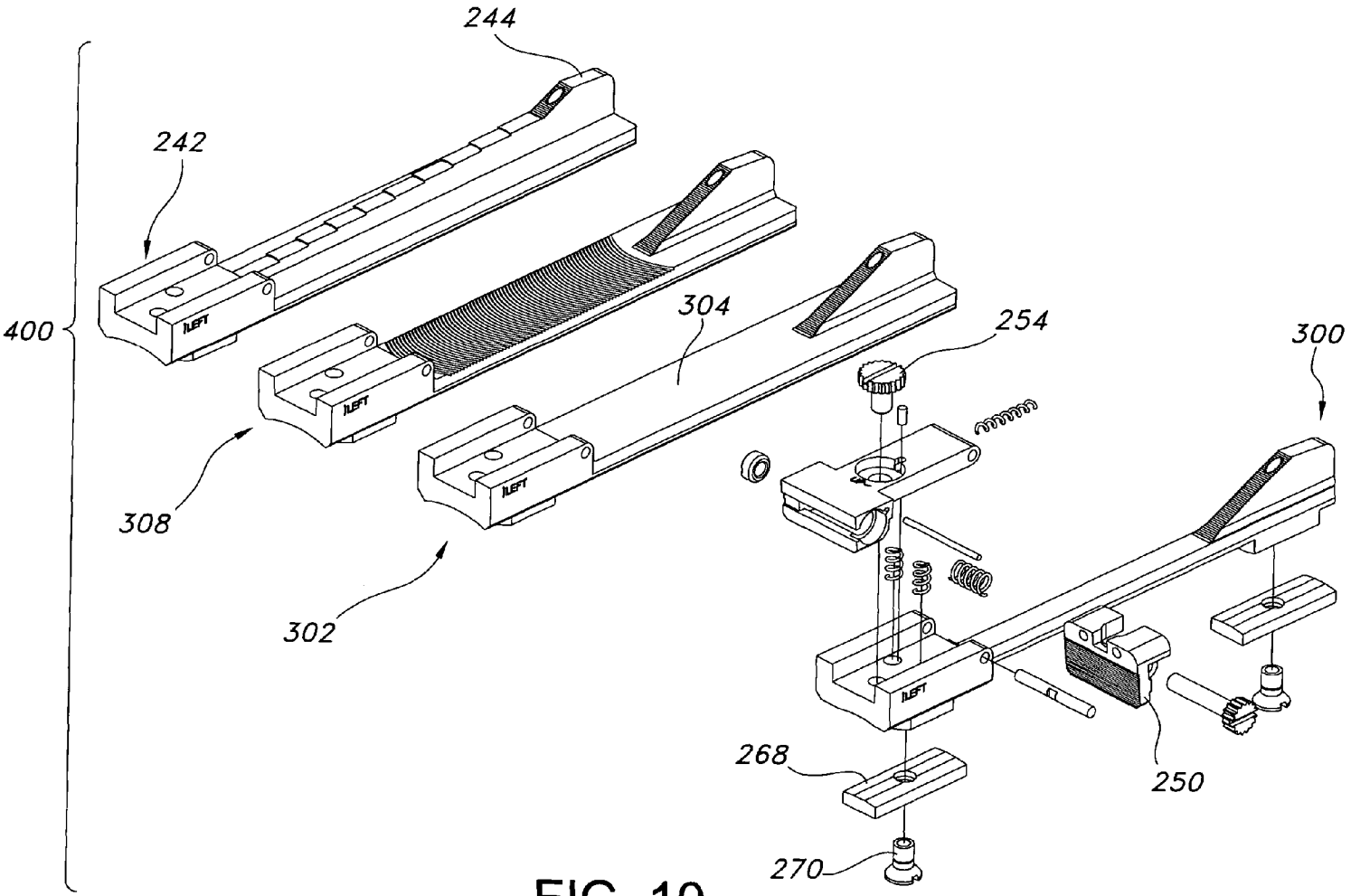
FIG. 10 illustrates a kit having a selection of sight base sub-assemblies and an exploded view of one sub-assembly (or one embodiment), in accordance with the present invention.
Figure 11:
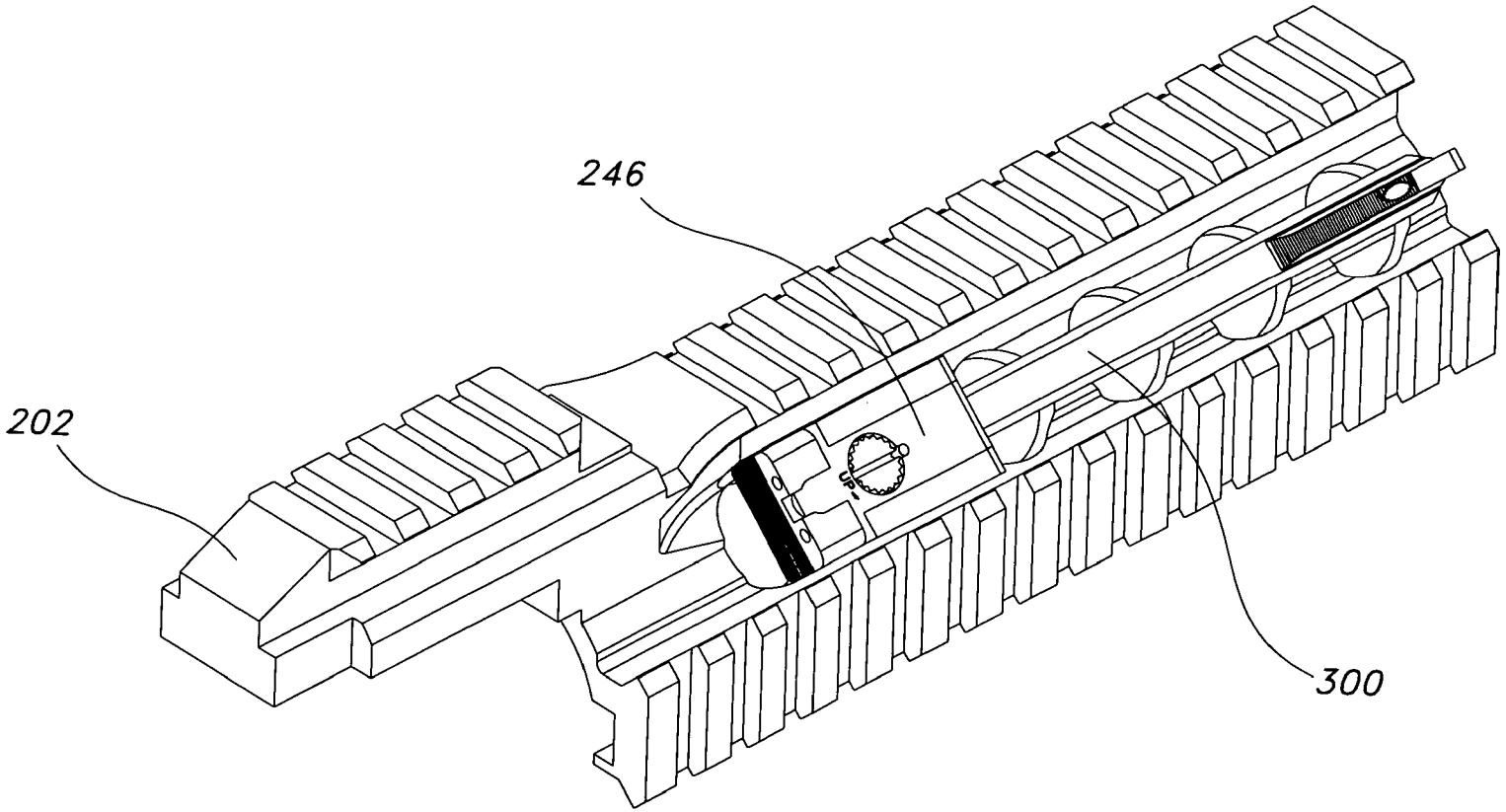
FIG. 11 illustrates a rear perspective view of a back-up sight and support, in accordance with the present invention.
Figure 12:
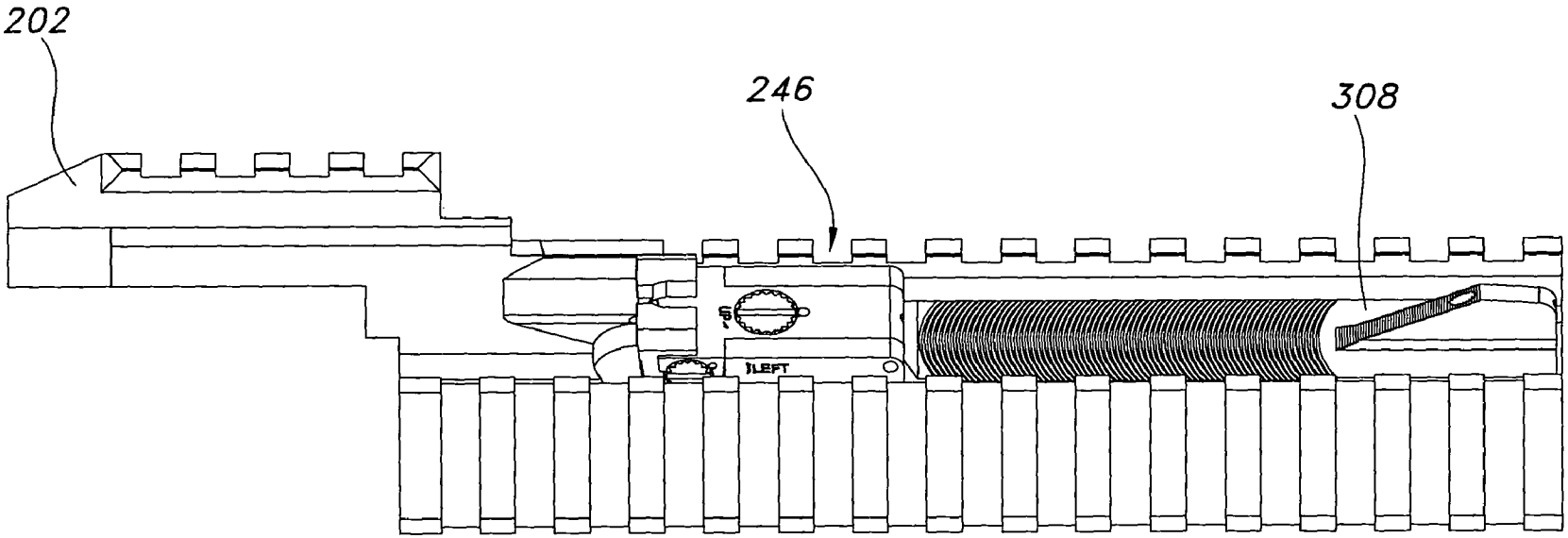
FIG. 12 illustrates a side view in elevation of another back-up sight and support, in accordance with the present invention.

FIG. 10 also illustrates a kit 400 having a selection of sight base sub-assemblies each of which can be optionally equipped with different styles of sights for different applications, in accordance with the present invention.

An advantage of these embodiments is that a shooter can have the back-up sights pre sighted-in with an elevation adjustment (e.g., using 254) and windage adjustment (e.g., using 262), having taken the rifle to the range ahead of time, so when the shooter needs to use the back-up sights and turns his or her wrist, everything should be dead on.

The components of the back-up sight assemblies are preferably made with very tight tolerances using, for example, using wire-cut EDM machining techniques, to ensure virtually perfect alignment front to rear, along the sighting axis.

The sight base is like a rib, and so can be welded in place or soldered, but is preferably attached via the mounting screws 270 and mounting plates 268 through the apertures or barrel-cooling holes 280 to engage the inside of the RIS handguard's sidewall. The RIS front handguard replacement is assembled from an upper half 202 and a lower half (e.g., as shown in FIG. 1) that are joined to make longitudinal seams, and the RIS top rail and the two side rails are incorporated into the upper half 202 while the bottom rail is incorporated into the lower half.

The back-up sight of the present invention makes the "eighth turn" or 45 degree cant motion easy to perform in an intuitive motion that permits the shooter to keep her or his eye on a target. In this motion, the shooter rolls from holding the gun straight up to a ⅛th turn and not a ¼ turn. This method of aligning the sights on a weapon where primary and secondary sights are available and holding the weapon in a first orientation when using primary sights and the rotating a weapon about the axis of a bore an eighth of a turn to bring into alignment the second sights, that motion is significant because when a shooter is holding the M4 or M16 by its pistol grip 126, it is natural and easy to quickly cant or rotate the rifle an ⅛ of turn, that its 45° out of 360°, and it feels remarkably natural. By way of contrast, if the user had to cant or rotate the rifle ¼ turn or 90°, the motion is un-natural and awkward.

The exemplary embodiments have shown the position of the back-up sight for a right handed shooter, who rotates the rifle counter-clockwise, as viewed from the shooter's perspective. The configuration for a left handed shooter places the back-up sight on the other side of the bore (the left side) and the left handed user, when aiming using those back-up sights, would cant or rotate the rifle one eighth rotation, but clockwise.

Having described preferred embodiments of a new and improved apparatus and method, it is believed that other modifications, variations and changes will be suggested to those skilled in the art in view of the teachings set forth herein. It is therefore to be understood that all such variations, modifications and changes are believed to fall within the scope of the present invention as set forth in the following claims.

I claim:

1. A back-up sight for use on a rifle or carbine configured with an optical sight or a standard issue set of sights aligned on a first sight axis substantially parallel with a central axis of the carbine's barrel, comprising:

(a) a handguard or support affixed to the rifle and having an exterior surface defining at least a first attachment point;

(b) a back-up sight configured to be releasably mounted on said handguard or support and aligned along a second sight axis parallel with the central axis of the rifle's barrel, said back-up sight including a front sight configured to be releasably mounted distally on said handguard and a rear sight configured to be releasably mounted proximally from said front sight on said handguard and spaced from said front sight on said second sight axis; and (c) wherein said second sight axis is radially offset to one side of said first sight axis such that by rotating the rifle to a selected rotation angle of less than ninety degrees about the axis of the barrel, a user may look down the second sighting axis, while aiming the rifle at a target.

2. The back-up sight of claim 1, wherein said selected rotation angle is approximately one eighth turn from vertical about the axis of the barrel.

3. The back-up sight of claim 2, wherein said selected rotation angle is approximately one eighth turn from vertical in the counterclockwise direction.

4. The back-up sight of claim 2, wherein said handguard or support comprises a replacement front handguard for an AR family rifle.

5. The back-up sight of claim 4, wherein said handguard or support comprises a replacement front handguard for an M4.

6. The back-up sight of claim 4, wherein said handguard or support comprises a replacement front handguard for an M16.

7. The back-up sight of claim 2, said back-up sight comprises a back-up front sight and back-up rear sight carried on a back-up sight base, wherein said sight base, said back-up front sight and said back-up rear sight are aligned along said second sight axis parallel with the central axis of the rifle's barrel.

8. The back-up sight of claim 2, wherein said handguard or support comprises a replacement front handguard including first, second, third and fourth parallel, longitudinal picatinny-style mounting rails.

9. The back-up sight of claim 8, wherein said first longitudinal picatinny-style mounting rail is on the top of the handguard.

10. The back-up sight of claim 9, wherein said second longitudinal picatinny-style mounting rail is offset ninety degrees from said first rail on the left side of the handguard, said third longitudinal picatinny-style mounting rail is offset one hundred eighty degrees from said first rail on the bottom of the handguard and said fourth longitudinal picatinny-style mounting rail is offset ninety degrees from said first rail on the right side of the handguard.

11. The back-up sight of claim 10, wherein handguard sidewall segments span the spaces between the rails; and wherein at least one of the handguard sidewall segments spanning the space between the rails has a plurality of apertures defined therein, said sidewall apertures being substantially aligned along an axis between said rails.

12. The back-up sight of claim 11, wherein said back-up sight base carries at least a first fastener adapted to releasably engage said handguard sidewall apertures.

13. The back-up sight of claim 1, wherein said front sight includes a tritium insert.

14. The back-up sight of claim 13, wherein said rear sight includes at least one tritium insert.

15. The back-up sight of claim 13, wherein said rear sight includes first and second tritium inserts.

16. The back-up sight of claim 1 wherein said rear sight includes a rear sight blade with a sighting notch.

17. The back-up sight of claim 1, wherein said rear sight is adjustable for windage.

18. The back-up sight of claim 1, wherein said rear sight is adjustable for elevation.

19. The back-up sight of claim 18, wherein said rear sight is also adjustable windage.

20. The back-up sight of claim 1, wherein said handguard or support has an exterior surface and an interior surface with plurality of aligned apertures therethrough;

and wherein said back-up sight is configured to be releasably mounted on said handguard or support by fastening at least one retaining plate to said back-up sight and against the interior surface of the handguard or support.

* * * * *